US012442099B2

(12) United States Patent
Boardman

(10) Patent No.: US 12,442,099 B2
(45) Date of Patent: Oct. 14, 2025

(54) ELECTROPLATING SOLUTIONS

(71) Applicant: JOHNSON MATTHEY PUBLIC LIMITED COMPANY, London (GB)

(72) Inventor: Alan Boardman, Reading (GB)

(73) Assignee: Johnson Matthey Public Limited Company, London (GB)

( * ) Notice: Subject to any disclaimer, the term of this patent is extended or adjusted under 35 U.S.C. 154(b) by 0 days.

(21) Appl. No.: 18/250,487

(22) PCT Filed: Dec. 16, 2021

(86) PCT No.: PCT/GB2021/053322
§ 371 (c)(1),
(2) Date: Apr. 25, 2023

(87) PCT Pub. No.: WO2022/129916
PCT Pub. Date: Jun. 23, 2022

(65) Prior Publication Data

US 2023/0407507 A1 Dec. 21, 2023

(30) Foreign Application Priority Data

Dec. 18, 2020 (GB) ..... 2020071

(51) Int. Cl.
*C25D 3/52* (2006.01)
*C25D 3/50* (2006.01)

(52) U.S. Cl.
CPC *C25D 3/52* (2013.01); *C25D 3/50* (2013.01)

(58) Field of Classification Search
None
See application file for complete search history.

(56) References Cited

U.S. PATENT DOCUMENTS

| | | | |
|---|---|---|---|
| 3,530,050 A | 9/1970 | Matthey | |
| 4,545,868 A | 10/1985 | Martin et al. | |
| 4,715,935 A | 12/1987 | Lovie et al. | |
| 5,102,509 A | 4/1992 | Albon et al. | |
| 6,306,277 B1 | 10/2001 | Strangman et al. | |
| 2002/0144909 A1 | 10/2002 | Shinji | |
| 2011/0147225 A1 | 6/2011 | Zhang-Beglinger et al. | |

FOREIGN PATENT DOCUMENTS

| | | | | |
|---|---|---|---|---|
| CN | 108 004 573 B | | 10/2020 | |
| EP | 0358375 A1 | | 3/1990 | |
| EP | 2017373 A2 | | 1/2009 | |
| GB | 1 062 681 A | | 3/1967 | |
| JP | 2016089203 A | * | 5/2016 | |
| WO | WO-2009099067 A1 | * | 8/2009 | ..... C23C 18/44 |
| WO | 2012/095667 A2 | | 7/2012 | |
| WO | 2013/104877 A1 | | 7/2013 | |
| WO | WO-2019031792 A1 | * | 2/2019 | ..... H01M 4/92 |

OTHER PUBLICATIONS

Machine translation of Yukihisa et al. JP2016089203A (Year: 2016).*
Machine translation or Chai et al. WO 2019031792 A1 (Year: 2019).*
Machine translation of Kubota WO 2009099067 A1 (Year: 2009).*

* cited by examiner

*Primary Examiner* — Wojciech Haske
(74) *Attorney, Agent, or Firm* — BakerHostetler

(57) ABSTRACT

The invention relates to an aqueous electroplating solution for alkaline electroplating, comprising: [M(NH3)4]2+ ions, wherein M is selected from the group consisting of Pd or Pt; and organic anions selected from the group consisting of bicarbonate, carbonate, or a mixture thereof; wherein the following species, if present, are present in the following amounts: alkali metals in an amount of less than 5 g/L; compounds comprising phosphorus in an amount of less than 5 g/L; compounds comprising boron in an amount of less than 5 g/L. The invention also relates to an electroplating bath comprising the electroplating solution, and a method of forming a metal layer on a substrate by electroplating using the electroplating solution.

17 Claims, No Drawings

ELECTROPLATING SOLUTIONS

CROSS-REFERENCE TO RELATED APPLICATIONS

The present application is the U.S. national stage entry of PCT/GB2021/053322, filed Dec. 16, 2021, which claims the benefit of priority to GB 2020071.3, filed Dec. 18, 2020, the entire contents of both of which are incorporated herein by reference.

FIELD OF THE INVENTION

The present invention relates to electroplating solutions containing a source of Pt or Pd ions.

BACKGROUND

Electroplating is a well-known technique for applying coatings of platinum and other platinum group metals onto conductive substrates or conductive ceramics. Although most substrates for plating are conductive metals or graphite, composites incorporating conductive fibres or particles may be considered, as may plastics or ceramics which have been treated to make them conductive (e.g. through the application of a keying metal deposit or flash coating, or by the application of a conductive paint). The coatings may be a thin "flash" coating used for jewellery, or several microns in thickness, generally up to about 20 μm, depending upon the intended use of the coated product. For certain applications such as electroformed free-standing parts, thicker coatings may be required. Electroplating is used to prepare coatings in a wide variety of applications including protective coatings, decorative coatings, conductive tracks for electronics, coatings to prepare electrodes (e.g. Pt-coated Ti)), and coatings for turbine blades.

Two major types of ammoniacal platinum plating baths have been introduced by Johnson Matthey in the last few decades, namely P Salt™ and Q Salt™. "P salt" is an ammoniacal solution of diammine dinitroplatinum (II), i.e. $Pt(NH_3)_2(NO_2)_2$. "Q salt" is an ammoniacal solution of tetraammineplatinum (II) hydrogen phosphate $Pt(NH_3)_2(HPO_4)$.

EP0358375A (Johnson Matthey Public Limited Company) describes an electroplating bath comprising a source of platinum (II) ions with the anion component being an organic or inorganic acid other than a hydrohalic acid. The invention is exemplified by complexes in which the anion is hydrogen phosphate, citrate or sulfamate, with the pH adjusted to approximately 10.5 using sodium hydroxide.

EP 2 017 373 A and US2011/0147225 (Rohm and Haas Electronic Materials LLC) describe a method of electroplating using an aqueous, ammonia-based bath which has reduced free ammonia in the bath. The bath comprises a source of palladium, ammonium ions and urea.

A wide variety of palladium compounds may be used as the source of palladium, including tetramine palladium carbonate and tetramine palladium hydrogencarbonate, although these are not exemplified. The examples include significant amounts of boron-containing compounds (boric acid) and sulfur-containing compounds (ammonium sulphate).

WO2012/095667 (Johnson Matthey Public Limited Company) describes an electroplating bath comprising a source of platinum ions and a source of polyphosphate anions. Various Pt(II) and P(IV) salts are suggested for the source of platinum ions. The exemplified baths range from pH 2 to 8 and include tetrasodium pyrophosphate, typically at a concentration above 10 g/L.

WO2013/104877 (Johnson Matthey Public Limited Company) describes an electroplating bath comprising a source of platinum ions and a source of borate ions. Various Pt(II) and P(IV) salts are suggested for the source of platinum ions. The exemplified baths include boron compounds such as boric acid, typically at a concentration above 10 g/L.

The plating baths described above generally include anions or cations which are incapable of decomposing to volatile products under typical electroplating conditions, meaning that these anions will build up in the bath over time. This is expected to lead to the associated problems of low plating rate and/or contamination of the coating with halide, sulphate, borate, phosphate, carbonate or metals other than those intended for plating. The present invention addresses this problem.

SUMMARY OF INVENTION

Contamination of an electroplated coating with impurities present in the electroplating bath is a known problem. For instance, U.S. Pat. No. 6,306,277 (Honeywell International, Inc.) describes the formation of platinum aluminide coatings and identifies the problem of S, CI and P impurities in the bath contaminating the coating. A solution to this problem is to eliminate the presence of S, CI and P in the bath, by using a bath comprising $Pt(NH_3)_2(NO_2)_2$ and 0.1 to 240 g/L of an alkali metal carbonate or bicarbonate, being substantially free of S, Cl and P impurities.

While the solution proposed by U.S. Pat. No. 6,306,277 may solve the problem of contamination with S, Cl and P impurities, it has been established by the present inventors that contamination of the coating with carbonate or bicarbonate can also occur when alkali metal carbonates or bicarbonates are included in the plating solution. On heating the coating to high temperatures carbonate and bicarbonate decompose to carbon dioxide which can result in coating defects. The presence of a high concentration of ions in the bath can also suppress the plating rate.

The present inventors have now identified particular electroplating solutions incorporating a tetraammine metal ion $[M(NH_3)_4]^{2+}$, where M is Pt or Pd, bearing counter anions which decompose under alkaline electroplating conditions, which significantly reduce or avoid the build-up of anions in the bath and thereby reduce or avoid contamination of the coating.

Unlike many other commercial alkaline electroplating solutions, the electroplating solutions of the present invention do not include appreciable amounts of alkali metals, compounds of phosphorus (e.g. phosphate) or compounds of boron (e.g. borate). These ions are non-volatile and therefore build up in the bath over time, which is believed to negatively impact bath performance (e.g. plating rate and efficiency). The electroplating solutions described herein show good plating properties and are expected to show low signs of contamination and improve the lifetime of the electroplating bath.

In a first aspect the invention provides an aqueous electroplating solution for alkaline electroplating, comprising:

- $[M(NH_3)_4]^{2+}$ ions, wherein M is selected from the group consisting of Pd or Pt; and
- organic anions selected from the group consisting of bicarbonate, carbonate, or a mixture thereof;
- wherein the following species, if present, are present in the following amounts:

alkali metals in an amount of less than 5 g/L;

compounds comprising phosphorus in an amount of less than 5 g/L;

compounds comprising boron in an amount of less than 5 g/L.

It will be appreciated by those skilled in the art that there may be partial exchange of the ammine ligands for aqua or hydroxide ligands over time. However, this is a slow process, particularly at room temperature.

It is also within the scope of the invention for the metal M to be selected from the group consisting of Re, Ru, Rh, Ir and Os. These metals have a more extensive range of oxidation states than Pt and Pd, and also form mixed ammine/hydroxide or ammine/aqua complexes. Where plating is carried out using Re, Ru, Rh, Ir and Os then the electroplating solution comprises $[M(NH_3)_{6-x}(OH)_x]$ ions, where M is Re, Ru, Rh, Ir or Os, in place of $[M(NH_3)_4]^{2+}$. The values of x, y and n will depend on the oxidation state of the metal and the number of hydroxide ligands. The skilled person will be aware of suitable ions. Suitable ions include $[Ru(NH_3)_6]^{3+}$, $[Rh(NH_3)_6]^{3+}$, $[Ir(NH_3)_6]^{3+}$ or $[Os(NH_3)_6]^{3+}$.

During electroplating the substrate to be plated acts as the cathode. Metal ammine ions are reduced at the cathode, metal M is deposited on the cathode as a coating and ammonia is released. The organic anion(s) decompose to gas either non-electrolytically or following oxidation at the anode. Ammonia is volatile under the temperatures typically used for electroplating (60-100° C.).

An important distinction between the present invention and the electroplating solutions described in U.S. Pat. No. 6,306,277 (Honeywell International, Inc.) is that the instant electroplating solutions are substantially free of alkali metals. In the worked example of this patent the electrolyte includes 100 g sodium carbonate in 1 L water (alkali metal concentration approximately 46 g/L) In addition, in this reference P Salt $Pt(NH_3)(NO_2)_2$ is used as the source of Pt rather than $[M(NH_3)_4]^{2+}$ in the present invention.

The present inventors have established that the presence of large amounts of alkali metals, as used in U.S. Pat. No. 6,306,277, prevents the carbonate/bicarbonate ions from decomposing. This is likely to impact negatively on bath performance (e.g. plating rate) and efficiency. However, in the absence of such metals, carbonate/bicarbonate ions do decompose under typical alkaline electroplating conditions, approximated by the following equations:

$$2HCO_3^- \rightarrow CO_2 + CO_3^{2-} + H_2O$$

$$CO_3^{2-} + H_2O \rightarrow CO_2 + 2OH^-$$

As will be described in later sections, other preferred organic anions are those which decompose to volatile products under typical electroplating conditions.

It is known in the art that the plating rate of an electroplating bath tends to drop off over time, ultimately reaching levels where plating is no longer commercially viable and requiring the bath to be regenerated. Without wishing to be bound by any theory, the present inventors believe that the drop-off in plating rate is at least in part a consequence of the build-up of salts in the plating bath (e.g. the build-up of phosphate in platinum Q Salt baths, which include phosphate as a buffer). By reducing or eliminating the build-up of salts in the bath, it is expected that not only will contamination of the coating be less likely, but the bath lifetime may be extended and/or bath maintenance eased.

In a second aspect the invention provides an electroplating bath comprising a cathode and an anode which are both at least partially submerged in an electrolyte, wherein the electrolyte is an aqueous electroplating solution according to the first aspect.

In a third aspect the invention provides a method for forming a metal layer on a substrate by electroplating, wherein electroplating is carried out using a bath comprising a cathode and an anode which are both at least partially submerged in an electrolyte, wherein the electrolyte is an aqueous electroplating solution according to the first aspect.

DETAILED DESCRIPTION

Any sub-headings are included for convenience only, and are not to be construed as limiting the disclosure in any way.

Electroplating Solution

In a first aspect the invention provides an aqueous electroplating solution for alkaline electroplating, comprising:

$[M(NH_3)_4]^{2+}$ ions, wherein M is selected from the group consisting of Pd or Pt; and organic anions selected from the group consisting of bicarbonate, carbonate, or a mixture thereof; wherein the following species, if present, are present in the following amounts:

alkali metals in an amount of less than 5 g/L;

compounds comprising phosphorus in an amount of less than 5 g/L;

compounds comprising boron in an amount of less than 5 g/L.

The electroplating solution includes organic anion(s) (i.e. an anion comprising at least one carbon atom) selected from the group consisting of bicarbonate, carbonate, or a mixture thereof. Such a solution may suitably be prepared by dissolving the requisite metal salt (e.g. $[M(NH_3)_4](HCO_3)_2$) in aqueous solution.

The organic anions present in the electroplating solutions of the present invention are anions which decompose under conditions typically used for alkaline electroplating (pH>7, 60-100° C.) into volatile products. Under typical electroplating conditions the organic anions will form the corresponding ammonium salts in solution. Ammonium bicarbonate/carbonate decompose to carbon dioxide and water.

It is possible that some of these anions may decompose to give products other than those listed above, but in general these anions decompose to volatile products and do not substantially build up in the bath over time.

The organic anions are typically present in an amount sufficient to counterbalance the $[M(NH_3)_4]^{2+}$ ions, e.g. in the case where the organic anion has a charge of −2 under typical electroplating conditions (e.g. carbonate) then the molar ratio of $[M(NH_3)_4]^{2+}$ to carbonate should be approximately 1:1. Where the organic anion has a charge of −1 under typical electroplating conditions (e.g. bicarbonate) then the molar ratio of $[M(NH_3)_4]^{2+}$ to bicarbonate should be approximately 1:2. Stated alternatively, the molar ratio of M (Pd or Pt):organic ligand in the electroplating solution is approximately 1:1 (in the case of an anion having a charge of −2), and approximately 1:2 (in the case of an anion having a charge of −1). Here, "approximately" means within ±20% of the theoretical 1:1 or 1:2 ratio, i.e. 1:0.8 to 1:1.2 in the case of an anion having a charge of −2, and 1:1.6 to 1:2.4 in the case of in the case of an anion having a charge of −1. These ratios relate to a ready to use bath; it will be appreciated from the preceding discussion that the anions will decompose thermally and/or electrochemically over time and therefore this ratio will change during use of the bath. The ratio of bicarbonate and carbonate ions in the electroplating solution depends on pH. Preferably, the molar ratio of M (Pt or Pd):(bicarbonate+carbonate) is approximately 1:2 when prepared from $[M(NH_3)_4](HCO_3)_2$ and approximately 1:1 when prepared from $[M(NH_3)_4](CO_3)$. "Approximately" takes the meaning given above.

In some situations the electroplating solution may be prepared from $[M(NH_3)_4](HCO_3)_2$ or $[M(NH_3)_4](CO_3)$ and additional carbonate/bicarbonate may be added (e.g. small amounts of alkali metal (bi)carbonate or ammonium carbonate) to adjust pH. In this embodiment, the ratio of M:(bicarbonate+carbonate) is from 1:1 to 1:10 preferably from 1:1 to 1:5.

It will be understood that bicarbonate and carbonate are present in the solution in a ratio which is dependent on pH. It is especially preferred that bicarbonate and carbonate are the only organic anions present in the electroplating solution.

Tetraammine platinum bicarbonate is commercially available (CAS 123439-82-7) and the electroplating solution may conveniently be prepared by dissolving the metal salt in solution.

The content of M ion in an electroplating solution "ready for use" is typically 1 to 30 g/L (on a metal basis). Preferred concentrations depend upon the product to be coated and the coating apparatus but are typically 5 to 30 g/L or 5 to 25 g/L for most normal operations. It will be appreciated that the electroplating solution may be supplied in a more concentrated form and then diluted prior to use. Dilution may be achieved, for instance, using deionized water and then adjusting the pH if necessary.

The metal M is present substantially, preferably entirely, as $[M(NH_3)_4]^{2+}$ ions, e.g. $[Pt(NH_3)_4]^{2+}$ ions.

The pH of the electroplating solution will depend on the choice of metal and the choice of organic anion. In general, the pH of the electroplating solution will be alkaline with a pH above 7. Preferably the electroplating solution will have a pH of 8 to 14, preferably 8 to 13, more preferably 9 to 12, especially preferably 9 to 11.

The electroplating solution will typically include a pH adjusting agent which is volatile and/or decomposes to volatile products under the alkaline plating conditions. Suitable pH adjusting agents for use in the present invention are ammonia, urea, an alkylammonium hydroxide, ammonium hydroxide, ammonium bicarbonate and ammonium carbonate. Unlike known plating baths which typically use pH adjusting agents such as alkali metal hydroxides and/or hydrohalic acids to adjust pH, the pH adjusting agent(s) used in the present invention does not build up in the bath over time as the electroplating solution is replenished. These agents decompose to ammonia, carbon dioxide and water which are volatile under alkaline electroplating conditions.

Ammonium hydroxide is a particularly preferred pH adjusting agent.

Care should be taken when using ammonium carbonate as a pH adjusting agent as this compound can violently decompose when added as a solid at high temperatures. Ammonium carbonate should only be added as a dilute aqueous solution when the bath is at room temperature. Alternatively, solid ammonium carbonate can be added to a solution at a temperature below 60° C.

The content of alkali metal(s) in the aqueous electroplating solution, if present, is less than 5 g/L, preferably less than 2 g/L, more preferably less than 1 g/L. In preferred embodiments the content of alkali metal(s) is less than 0.5 g/L, preferably less than 0.1 g/L, preferably less than 0.08 g/L, more preferably less than 0.05 g/L, more preferably less than 0.02 g/L. If more than one alkali metal is present then these levels apply to the combined amounts of alkali metals.

It is preferred that the aqueous electroplating solution is free of alkali metals, i.e. that any alkali metals are present at the trace impurity level.

Although the presence of alkali metals is generally to be avoided in the present invention, on some occasions it may be appropriate to include low levels of an alkali metal hydroxide, carbonate or bicarbonate as a pH adjuster, provided that the levels of alkali metal do not build to an extent which prevents decomposition of the organic anion(s). If alkali metals are present in the electroplating solution, then their concentration is less than 5 g/L.

It is preferred that the combined content of metal(s) other than M in the aqueous electroplating solution is less than 5 g/L, preferably less than 2 g/L, more preferably less than 1 g/L. In preferred embodiments the combined content of metal(s) other than M is less than 0.1 g/L, preferably less than 0.05 g/L, more preferably less than 0.02 g/L. If more than one metal (other than M) is present then these levels apply to the combined amounts of metals. It is preferred that the aqueous electroplating solution is free of metals other than M, i.e. that any metals other than M are present at the trace impurity level only.

As noted previously, it is known from U.S. Pat. No. 6,306,277 (Honeywell International, Inc.) that the presence of halogens, boron and phosphorus compounds can lead to contamination of the coating. The present inventors also believe that the build-up of these anions in the bath over time as the electroplating solution is replenished negatively impacts plating performance and is another reason why the presence of these ions should be avoided.

The content of any compounds containing phosphorous (e.g. phosphate, hydrogen phosphate etc. . . . ) in the electroplating solution is less than 5 g/L, preferably less than 2 g/L, more preferably less than 1 g/L, more preferably less than 0.5 g/L, if present at all.

The content of any compounds containing boron (e.g. borate) in the electroplating solution is less than 5 g/L, preferably less than 2 g/L, more preferably less than 1 g/L, more preferably less than 0.5 g/L, if present at all.

The content of halide ions (i.e. fluoride, chloride, bromide, iodide) in the electroplating solution is preferably less than 5 g/L, preferably less than 2 g/L, more preferably less than 1 g/L, more preferably less than 0.5 g/L, if present at all.

The present inventors have also established that sulfur and silicon compounds should be avoided, as these compounds can build up in concentration over time and impact and decrease the plating rate and/or lead to impurities in the coating.

It is preferred that the content of any compounds containing silicon in the electroplating solution is preferably less than 0.5 g/L, preferably less than 0.2 g/L, preferably less than 0.1 g/L, preferably less than 0.02 g/L, if present at all.

It is preferred that the content of any compounds containing sulfur in the electroplating solution is preferably less than 0.5 g/L, preferably less than 0.2 g/L, preferably less than 0.2 g/L, preferably less than 0.1 g/L, if present at all.

It is preferred that the electroplating solution is substantially free of nitrite ions ($NO_2^-$ ions). Preferably the content of nitrite ions is less than 0.5 g/L, preferably less than 0.2 g/L, preferably less than 0.1 g/L. This applies to nitrite ions whether free in solution or complexed to the metal M.

It is preferred that the electroplating solution is substantially free of nitrate ions ($NO_3^-$ ions). Preferably the content of nitrate ions is less than 0.5 g/L, preferably less than 0.2 g/L, preferably less than 0.1 g/L. This applies to nitrate ions whether free in solution or complexed to the metal M.

It is also within the scope of the invention for the electroplating solution to include low levels of additives such as levellers, brighteners, wetting agents, colour adjusting reagents etc provided that they do not adversely alter bath performance.

Preparing the Electroplating Solution

Aqueous electroplating solutions according to the present invention can be prepared simply by dissolving the required metal salt and pH adjuster in water, typically deionized water. The order of addition is not particularly important, but typically a salt of the desired tetraammine metal complex is first dissolved in hot water (typically 80-95° C.) to reach the desired concentration, followed by addition of pH adjusting agent to reach the desired pH for plating. The electroplating solution is then ready to be used for plating.

The salt may be selected from the group consisting of a palladium tetraammine bicarbonate, palladium tetraammine carbonate, platinum tetraammine bicarbonate or platinum tetraammine carbonate. Preferably a single salt is used.

Alternatively, the salt may be a mixture of tetraammine palladium or tetraammine platinum dihydroxide and another salt selected from tetraammine palladium or tetraammine platinum bicarbonate or carbonate. Where a tetraammine metal dihydroxide salt is included, a further pH adjuster may not be required. Tetraamine metal dihydroxide salts have the benefit that they produce by-products which do not build up in the bath, namely ammonia and water.

In the case where a mixture of $[M(NH_3)_4](OH)_2$ and $[M(NH_3)_4](HCO_3)_2$ or $[M(NH_3)_4](CO_3)$ are used, the molar ratio of M:(bicarbonate+carbonate) may be lower than 1:1. For example, the ratio may be as low as 1:0.1, such as 1:0.2 or 1:0.5. The ratio may be as high as 1:10, such as 1:5 or 1:2.

Alternative Organic Anions

In an alternative embodiment, the organic anion is selected from the group consisting of acetate, carbamate, cyanate, formate and oxalate, or a mixture thereof. Preferably a single anion from this list. Without wishing to be bound by theory, it is thought that these anions also decompose under electroplating conditions as follows: acetate to acetamide; carbamate to carbon dioxide and ammonia; cyanate to urea; formate to carbon dioxide; oxalate to carbon dioxide.

Preferred properties of the electroplating solution (content of M, ratio of M:organic anion etc. . . . ) set out above in connection with bicarbonate or carbonate also apply when the anion is selected from acetate, carbamate, cyanate, formate and oxalate.

While formate and oxalate will decompose under typical alkaline electroplating conditions, they are known to be reducing and may reduce the metal M over time. The plating conditions may need to be tightly controlled when the organic ion is formate or oxalate.

Acetate, carbamate and cyanate have the benefit that they are non-reducing anions and therefore M will not be reduced unless current is applied.

Electroplating Method

In a second aspect the invention provides an electroplating bath comprising a cathode and an anode which are both at least partially submerged in an electrolyte, wherein the electrolyte is an aqueous electroplating solution according to the first aspect.

Electroplating solutions according to the first aspect of the invention can be used in a wide variety of electroplating methods, including but not limited to: tank plating (aka vat plating), barrel plating, pulse plating and reel to reel plating.

In one embodiment the electroplating bath may be a barrel plating bath. A barrel plating bath includes a rotating drum into which the parts to be plated are placed, and which rotates while submerged in an electrolyte. The barrel includes numerous cathode electrical contacts which attract the metal to be plated from the electrolyte onto the parts. The cathode may be in the form of spikes, mesh, rods or flexible danglers, for instance.

In an alternative embodiment, the substrate on which a coating is to be applied is held static during plating and either partially or fully submerged in the electrolyte. The substrate acts as the cathode and a coating of metal is applied on the substrate during electroplating. The anode is typically provided by an inert conductor, such as a platinised titanium or platinised niobium mesh or plaque, an inert metal or inert alloy, a platinum group metal mixed metal oxide, a conductive carbon material or a conductive ceramic. Electroplating is achieved by passing a current between the electrodes.

The size of the anode and location relative to the substrate (acting as cathode) is chosen so as to achieve a good plating on the cathode. In the case of substrates having a complicated geometry, two or more anodes may be present per substrate in order to achieve the desired coating.

It will be appreciated that a commercial electroplating bath will typically include multiple cathodes and multiple anodes.

In general the substrate will be fully submerged where a coating over the entire substrate is required (e.g. jewellery or medical components such as stents), and partially submerged where only a partial coating on the substrate is required.

The current density and operating voltage used for plating will be readily determined by those skilled in the art, and may depend on the required plating thickness, shape of the part to be plated and plating method.

In general, a current density of 1-10 $A/ft^2$ has been found to be appropriate for tank plating. The current may be continuous or pulsed. A current density of 1-8 $A/ft^2$ is preferred in the case of baths based on tetraammine platinum bicarbonate or tetraammine platinum carbonate, as a current density of 10 $A/ft^2$ has been observed to cause "burning" of the plated part.

A typical operating temperature for the bath is 60 to 100° C. and a pH of 8 to 14. Under these conditions the organic anion(s) decompose to volatile products and therefore do not build up in the bath. Temperatures of 80-95° C. are particularly preferred.

In a third aspect the invention provides a method of forming a metal layer on a substrate by electroplating, wherein electroplating is carried out using a bath comprising a cathode and an anode which are both at least partially submerged in an electrolyte, wherein the electrolyte is an aqueous electroplating solution according to the first aspect.

Electroplating using the aqueous electroplating solution of the present invention is typically carried out at a plating temperature of 80° C. or more.

The pH of the electrolyte may vary over time as the pH adjusting agent volatilises. It is preferred that the bath is replenished with fresh pH adjusting agent as required.

The metal in the electroplating solution is consumed over time and it is therefore necessary to replenish the bath with a source of M ions. This may be achieved by adding fresh electroplating solution as required, or by adding a solid source of M ions (e.g. $[M(NH_3)_4](HCO_3)_2$, etc. . . . ) as a solid or a solution. Preferably fresh electroplating solution is added as a dilute solution to a bath at or near room temperature.

It is preferred that the electrolyte is periodically or continuously agitated to ensure transport of ions to the electrodes and to avoid stagnation around the electrodes, which otherwise leads to poor plating performance.

The electroplating method may include the step of pausing electroplating and increasing the temperature of the electrolyte in order to purge the bath of residual organic anion which may have built up. This will typically only be necessary where plating is carried out under conditions which are not sufficient to decompose the organic anion, or only decompose the organic anion at a low rate. This may particularly be the case where plating is carried out at low temperatures (e.g. temperatures below 70° C.). Pausing the electroplating process may be achieved by removing the cathode and/or anode from the bath, and/or by switching off the current to the anode and cathode. The temperature of the electrolyte is then raised to allow the organic anion to decompose. The temperature is typically raised by 5-20° C., such as 10-20° C. The concentration of the organic anion in the bath may be monitored by well known analytic methods. Once the concentration of organic anion has been reduced to suitably low levels the temperature of the electroplating solution is then reduced to the plating temperature and plating is restarted.

The invention will now be illustrated by the following examples, which are not intended to limit the invention in any way.

EXAMPLES

The shaped substrates for plating were stainless steel (approximately 13.7 $cm^2$) and were treated before use by grit blasting with 180/220 brown aerospace grit and alkali cleaning using 1M sodium hydroxide for 6 minutes at a temperature of at least 60° C.

The plating bath was provided by a 400 mL glass beaker placed on a magnetic stirrer/heater (Bibby Scientific, model US152). The test substrate was weighed prior to plating using a 4 figure laboratory balance. A jig was assembled comprising a test substrate and two anodes. The test substrate was held in place by means of a screw threaded rod with the other end of the rod clamped to the jig. An anode was provided on each side of the substrate facing towards the concave surface of the substrate at a distance of approximately 1 cm. The anodes were provided by Metakem Type A platinised/titanium mesh fixed to the jig at one end. The anodes and cathode were connected up to a power pack (benchtop single output laboratory powerpack from AIM-TTI Instruments, model ER302R, 30V and 2 A range). The jig was moved into position such that the test substrate was fully submerged in the electrolyte; the anodes were partially submerged in the electrolyte but were arranged so as to ensure coating of all surfaces of the substrate. The electrolyte was then heated to the required temperature using the stirrer/heater and the bath was magnetically stirred with a 2.5 cm long PTFE coated stirrer bar on a low setting.

In Example 1 the plating solution was pre-treated by heating to a temperature of 90° C. for a period of approximately 15 minutes. Ammonia solution (35% solution from Fisher Scientific, specific gravity 0.88 g/L, 2 mL) was added to produce a solution with a pH of 10-10.5 pH was measured using 3 zone 'traffic light type' plastic strips from Merck.

Once pH adjustment was complete the power pack was turned on to provide a fixed 89 mA (6 $A/ft^2$) current which was held constant throughout each run. After the time specified (45 mins or 60 mins) the current was turned off, the substrate was unscrewed from the threaded rod and the replaced with a fresh substrate. Following drying of the substrate the mass gain was noted. Some platinum was plated onto the threaded rod but this was not taken into account in the bath efficiency calculations.

The bath was replenished with room temperature deionised water back to the original volume (a loss of ~25 mL in volume was typical between runs). Aqueous ammonia solution was added by pipette to achieve a pH of 10-10.5. Once the solution had heated back up to 90° C. the current was switched on to begin the next run.

Conductivity was determined using a Jenway meter supplied by Fisher Scientific calibrated against 0.1 molar potassium chloride solution at 20° C.

Example 1

A solution of tetraammine platinum bicarbonate was prepared by dissolving tetraammine platinum bicarbonate (Johnson Matthey) in water at 60° C. to achieve a Pt concentration of 20 g/L. A 250 mL portion of this solution was used as the electroplating solution for Run 1 (total Pt content approximately 5 g).

| Run | Voltage range during plating (V) | Weight of Pt plated (g) [cumulative] | Cathodic Current Efficiency % | Plating time (minutes) | pH of bath at plating temperature (90° C.) |
|---|---|---|---|---|---|
| 1 | 1.70-1.74 | 0.1878 | 77.34 | 45 | 10 |
| 2 | 1.66-1.81 | 0.1670 | 68.78 | 45 | 10 |
| 3 | 1.70-1.77 | 0.1387 [0.4935] | 57.12 | 45 | 10 |
| 4* | 1.62-1.74 | 0.1361 | 56.05 | 45 | 10-10.5 |
| 5 | 1.65-1.76 | 0.1262 | 51.97 | 45 | 10 |
| 6 | 1.66-1.77 | 0.1455 [0.9013] | 59.92 | 45 | 10-10.5 |
| 7** | 2.07-2.45 # | 0.0625 | 25.74 | 45 | 10 |
| 8 | 1.92-2.27 | 0.1320 | 54.36 | 45 | 10 |
| 9 | 1.89-2.13 | 0.1468 [1.2426] | 60.46 | 45 | 10 |
| 10 | 1.99-2.30 | 0.1436 | 59.14 | 45 | 10 |
| 11*** | 1.89-1.93 | 0.1089 | 44.85 | 45 | 10 |
| 12 | 1.98-2.28 | 0.1229 [1.618] | 50.62 | 45 | 10 |

*Following Run 3 the bath was allowed to cool to room temperature. The following day the bath was replenished with deionized water up to a volume of 250 mL and warmed to 90° C. Aqueous ammonia was added to achieve the pH shown and plating was commenced.

**The solution from Run 6 was stored for approximately 15 months at room temperature before Run 7 was carried out. The electroplating solution was that from Run 6, topped up with deionized water to a total volume of 250 mL and with ammonia added to achieve pH 10. Significant gas release was observed at the start of Run 7.

***5 minutes after beginning Run 11, 20.5 mL of ammonium carbonate solution (9.6 g ammonium carbonate in 100 mL DI water) was added to the bath slowly and cautiously. Ammonium carbonate was supplied by Sigma Aldrich (ACS Reagent, ≥30.0% ammonia basis).

All of Runs 1-12 produced a bright plate.

After a drop in the CCE between Runs 1-3 the CCE stabilizes at around 50-60%. Wthout wishing to be bound by theory, it is thought that the bath may have adsorbed $CO_2$ during the extended storage between Runs 6 and 7, presumably present as carbonate or bicarbonate. The observed gassing and low CCE for Run 7 are consistent with electrochemical conversion of bicarbonate/carbonate to $CO_2$ during this run. The CCE of the bath quickly recovered to the 50-60% range.

On adding ammonium carbonate to the bath in Run 11 fizzing was observed, which was assumed to be the result of thermal and/or electrochemical conversion of carbonate to $CO_2$ which would explain the reduced CCE. The CCE quickly recovers (see Run 12).

Example 1—Extended Running (Runs 13 to 23)

Following Run 12 the sequence of replenishing the bath to a volume of 250 mL, pH adjustment to 9.5-10 and plating using a fresh substrate (stainless steel test pieces with a surface area~13.7 $cm^2$ as a current density of 6 $A/ft^2$) was repeated until a total of 2.75 g of Pt had been plated from the bath (total of 21 runs). The aim of these experiments was to test this bath to failure.

To accelerate the depletion of Pt, the residual solution from Run 21 was made up to 250 mL and split into two 125 mL portions. One portion was made up to 175 mL and used for the plating of a 5 cm×4 cm brass substrate with a total surface area of 40 $cm^2$; the current was adjusted to 258 mA to achieve a current of 6 $A/ft^2$. A further 0.1622 g of Pt was plated from this solution (Run 22) before the bath started to fail due to depletion of metal (Run 23). The conductivity of the bath gradually decreased as Pt was plated out. It should also be noted that there was no increase in conductivity between Runs 10 and 13 despite ammonium carbonate solution being added in Run 11, which indicates that carbonate ions are rapidly decomposed under the conditions used. The bath failed to plate once the conductivity dropped to 1.87 mS/cm at 21.0° C. (Run 23).

| Run | Conductivity of bath at beginning of Run |
|---|---|
| 10 | 8.08 mS/cm at 19.1° C. |
| 13 | 7.15 mS/cm at 18.5° C. |
| 16 | 5.72 mS/cm at 20.0° C. |
| 19 | 4.76 mS/cm at 20.0° C. |
| 22 | 3.02 mS/cm at 19.8° C. |
| 23 | 1.87 mS/cm at 21.0° C. |

After Run 23 the bath was evaporated to dryness at 90-95° C. to leave a residue of 0.0521 g. The residue was a white crystalline solid which darkened brown then turned a grey metallic colour on thermolysis.

Approximately 3 g of Pt was plated from the original solution containing 5 g of Pt in 250 mL. The deficit is Pt (i) plated onto the screw threaded support for the test piece; (ii) hydrated platinum oxide observed as an orange solid on the anodes; (iii) plated onto the PTFE stirrer bar and to some extent on the bottom of the glass beaker next to the heater surface; and (iv) residual in the 125 mL of solution separated after Run 21.

The low amount of residual solid proves that in the absence of spectator ions such as alkali metals, the bicarbonate/carbonate ions decompose under the alkaline electroplating conditions used and do not build up in the bath.

The bath rapidly achieves a CCE of 50-60% which is maintained across a wide range of Pt concentrations. The bath also quickly recovers its CCE following an extended period of inactivity as shown by Runs 7 and 8.

Example 2

A bath comprising 200 mL of a solution of tetraammine platinum bicarbonate (Pt concentration 20 g/L, total Pt content~4 g) was prepared as for Example 1. However, Run 1 began as soon as the temperature reached 90° C., without holding the solution at 90° C. for 15 minutes as in Example 1. No ammonia was added either prior to Run 1 or between subsequent runs; the pH reported is the natural pH of the bath. The substrate was replaced with a fresh substrate between each Run.

| Run | Voltage range during plating (V) | Weight of Pt plated (g) [cumulative] | Cathodic Current Efficiency % | Plating time (mins) | pH of bath at plating temperature (90° C.) |
|---|---|---|---|---|---|
| 1 | 1.93-2.16 | 0.2060 [0.2060] | 63.63 | 60 | 8.5-9.5 |
| 2* | 1.89-2.18 | 0.2250 | 69.50 | 60 | 9.5 |
| 3** | 1.93* | 0.2350 | 72.59 | 60 | 9.5-10 |
| 4*** | 1.98** | 0.0740 [0.515] | 30.48 | 45 | 9.5 |
| 5* | 1.92-2.11 | 0.2000 [0.715] | 61.78 | 60 | 9.5 |

*Following Run 1 and Run 4 the bath was allowed to cool to room temperature. The following day the bath was replenished with deionized water up to a volume of 250 mL and warmed to 90° C. then plating was commenced.
**For Run 3 plating was carried out on the coated piece produced in Run 2. All other Runs used fresh (uncoated) test pieces.
***3.25 g of ammonium carbonate was added in several portions over 2 minutes to the hot bath, leading to substantial gaseous decomposition.

The CCE of this bath increases between Runs 1-3. It is thought that this is because, unlike in Example 1 where a pre-treatment was carried out to convert carbonate in the bath to carbon dioxide, this conversion is carried out electrochemically which decreases the CCE for the first two runs. The CCE of Run 4 is also low because of the addition of ammonium carbonate which is electrochemically decomposed. However, the CCE quickly recovers (see Run 5).

All runs gave a bright plate.

The invention claimed is:

1. An electroplating bath comprising a cathode and an anode which are both at least partially submerged in an electrolyte, wherein the electrolyte is an aqueous electroplating solution comprising $[Pt(NH_3)_4]^{2+}$ ions; and organic anions selected from the group consisting of bicarbonate, carbonate, or a mixture thereof;

wherein the molar ratio of Pt: (bicarbonate+carbonate) is approximately 1:2; and wherein the following species, if present, are present in the following amounts:

alkali metals in an amount of less than 5 g/L;

compounds comprising phosphorus in an amount of less than 5 g/L;

compounds comprising boron in an amount of less than 5 g/L.

2. The electroplating bath as claimed in claim 1, wherein the concentration of Pt in the solution is 1 to 30 g/litre, on a metal basis.

3. The electroplating bath as claimed in claim 1, wherein the pH of the solution is 8 to 14.

4. The electroplating bath as claimed in claim 1, wherein the solution comprises a pH adjusting agent selected from the group consisting of ammonia, urea, an alkylammonium hydroxide, ammonium hydroxide, ammonium bicarbonate and ammonium carbonate.

5. The electroplating bath as claimed in claim 1, wherein the content of alkali metals in the solution is less than 0.1 g/L.

6. A method of forming a metal layer on a substrate by electroplating, wherein electroplating is carried out using a bath comprising a cathode and an anode which are both at least partially submerged in an electrolyte, wherein the electrolyte is an aqueous electroplating solution comprising $[Pt(NH_3)_4]^{2+}$ ions; and organic anions selected from the group consisting of bicarbonate, carbonate, or a mixture thereof;

wherein the molar ratio of Pt: (bicarbonate+carbonate) is approximately 1:2; and wherein the following species, if present, are present in the following amounts:

alkali metals in an amount of less than 5 g/L;

compounds comprising phosphorus in an amount of less than 5 g/L;

compounds comprising boron in an amount of less than 5 g/L.

7. The method as claimed in claim 6, wherein electroplating is carried out at a temperature of 80° C. or more.

8. The method as claimed in claim 6, wherein electroplating is carried out at a temperature of 60 to 100° C. or more and a pH of 8 to 14.

9. The method as claimed in claim 6, wherein the bath is replenished with fresh electroplating solution as required.

10. The method as claimed in claim 6, wherein a pH adjusting agent is added to the bath as required.

11. The method as claimed in claim 6, wherein the cathode provides the substrate to be coated.

12. The method as claimed in claim 6, comprising a step of pausing electroplating and increasing the temperature of the electrolyte in order to purge the bath of residual organic anion.

13. The method as claimed in claim 6, wherein the cathode acts as the substrate and is selected from jewellery, a medical component or an aviation component.

14. The method as claimed in claim 6, wherein the concentration of Pt in the solution is 1 to 30 g/litre, on a metal basis.

15. The method as claimed in claim 6, wherein the pH of the solution is 8 to 14.

16. The method as claimed in claim 6, wherein the solution comprises a pH adjusting agent selected from the group consisting of ammonia, urea, an alkylammonium hydroxide, ammonium hydroxide, ammonium bicarbonate and ammonium carbonate.

17. The method as claimed in claim 6, wherein the content of alkali metals in the solution is less than 0.1 g/L.

* * * * *